US005746529A

United States Patent [19]

Peters et al.

[11] Patent Number: 5,746,529

[45] Date of Patent: May 5, 1998

[54] CONTAINER FOR A FLUID PRODUCT

[75] Inventors: Bernd W. Peters, Solingen; Marie-Claude Bossert, Erkrath, both of Germany; Johannes Hubertus Jozef Maria Kelders, Drunen; Roy Edwin Van Swieten, Heusden, both of Netherlands

[73] Assignees: Henkel Kommanditgesellschaft auf Aktien, Germany; Raycap B.V., Netherlands

[21] Appl. No.: 682,650

[22] PCT Filed: Jan. 18, 1995

[86] PCT No.: PCT/EP95/00176

§ 371 Date: Sep. 5, 1996

§ 102(e) Date: Sep. 5, 1996

[87] PCT Pub. No.: WO95/20496

PCT Pub. Date: Aug. 3, 1995

[30] Foreign Application Priority Data

Jan. 27, 1994 [NL] Netherlands ..... 9400126
Jun. 17, 1994 [DE] Germany ..... 44 21 286.0

[51] Int. Cl.[6] ..... B43K 29/00; A46B 11/04

[52] U.S. Cl. ..... 401/18; 401/21; 401/26; 401/126; 401/260

[58] Field of Search ..... 401/126, 16, 18, 401/21, 25, 26, 260

[56] References Cited

U.S. PATENT DOCUMENTS

| | | | |
|---|---|---|---|
| 2,990,563 | 7/1961 | Davidson | 401/126 |
| 4,627,454 | 12/1986 | Dahm | 401/126 X |
| 4,812,071 | 3/1989 | Batra et al. | 401/264 |
| 4,886,080 | 12/1989 | Cole | 132/320 |
| 4,955,745 | 9/1990 | Vauquelin | 401/126 X |

FOREIGN PATENT DOCUMENTS

| | | |
|---|---|---|
| 2 327 740 | 5/1977 | France . |
| 32 40 152 | 5/1984 | Germany . |
| 905 943 | 9/1962 | United Kingdom . |
| 1311 039 | 3/1973 | United Kingdom . |
| 89 07053 | 8/1989 | WIPO . |
| 91 06232 | 5/1991 | WIPO . |

*Primary Examiner*—Steven A. Bratlie
*Attorney, Agent, or Firm*—Ernest G. Szoke; Wayne C. Jaeschke; Kenneth Watov

[57] ABSTRACT

A container for a free-flowing product, in particular typographic correction fluid, includes a tubular neck with an application aperture with a valve closure for the controlled application of metered quantities of the fluid to a substrate. The container remains, over an extended period, perfectly capable not only of applying spots of fluid precisely at a given point but also of applying the fluid over large areas. This is achieved by fitting the container with a second tubular neck with a second aperture and fitted with a removable closure cap with an integral applicator brush. Both tubular necks are disposed in the upper part of the container in such a way that the far end of the tubular neck with the application aperture projects out beyond the cap when the cap is in place over the second aperture.

9 Claims, 5 Drawing Sheets

CONTAINER FOR A FLUID PRODUCT

BACKGROUND 1.0. Field of the Invention

This invention relates generally to a container for a fluid product, more particularly for typographic correcting fluid.

2.0. Discussion of the Related Art

A pen-like container of the type in question for correcting fluid is already known. With a correcting pen of this type, it is possible in principle to apply correcting fluid very precisely to a substrate, generally paper. The valve closure ensures that the correcting liquid only flows out when the tip of the correcting pen is applied under sufficient pressure to the substrate. However, it has been found in practice that correcting pens of the type in question often do not work satisfactorily because the ball valve closure easily becomes blocked, so that satisfactory outflow of the correcting fluid is no longer guaranteed, and as a result is not sufficiently tight when not in use so that the correcting fluid can easily dry, making the correcting pen totally unusable. Another disadvantage is that, with a correcting pen of the type in question, considerable effort is required to coat large areas with correcting fluid.

Accordingly, relatively small bottle-like containers with a screw-on closure cap provided with an integrated brush-like applicator have also long been known for coating relatively large areas. Although it is possible with containers of this type to apply white or colored correcting fluid to paper over a relatively large area, precision application is not possible. Accordingly, different containers have to be kept available according to the particular application. Unfortunately, none of the hitherto known solutions provides a container with which correcting fluid can be precisely applied to a substrate reliably over a prolonged period.

SUMMARY OF THE INVENTION

Accordingly, the problem addressed by the present invention is to improve a container of the type in question to such an extent that not only precision application of the fluid product, but also application over a large area would be satisfactorily possible over a prolonged period.

According to the invention, this problem has been solved by a container of the type mentioned at the beginning which is characterized in that it comprises a second tube-like projection with a second opening provided with a removable closure cap with an integrated brush-like applicator, the two tube-like projections being arranged in the upper part of the container in such a way that the free end of the tube-like projection with the discharge opening extends freely beyond the closure cap when the second opening is closed.

With a container such as this, a fluid product, more particularly correcting fluid, can be applied to paper or to any other substrate both in precision spot-like form and over a large area, even over a prolonged period. In effect, it has surprisingly been found that, in contrast to known correcting pens, the valve closure of a container designed in accordance with the invention has no tendency to block because, through the opening of the second opening in use, the container is often ventilated with the result that no reduced pressure can build up in the container over a prolonged period. At the same time, diluent may also be introduced into the container through the second opening should this prove necessary when the container is in use over a prolonged period. Another major advantage is that, with one and the same container, correcting fluid can be applied to a substrate both precisely in spot-like form and over a large area, satisfactory handling of the usually small container being guaranteed by the special arrangement of the two openings relative to one another. In addition, the present container can be repeatedly reused after complete emptying by the reintroduction of correcting fluid through the second opening from a storage bottle. In addition, the arrangement of the two openings on the same side of the container enables the fluid product to be applied through the discharge opening without flowing out from the second opening, even when it is open.

In one particularly advantageous embodiment of the invention, the two tube-like projections are arranged at an acute angle to one another, the angle between the two tube-like projections preferably being between 20° and 40°. By virtue of this arrangement, it is possible with particular advantage to solve the ergonomic problems involved in handling small containers of the type in question because this arrangement provides both for satisfactory precision application by the application tip in the manner of a ball-point pen and also for removal of the product by means of the brush-like applicator.

An ergonomically advantageous embodiment of the invention is that, in the standing position of the container, the tube-like projection with the discharge opening has a vertically extending longitudinal axis while the second tube-like projection is correspondingly laterally aligned.

The second opening with the brush-like applicator inserted therein is effectively sealed by a elastic seal between the brush-like applicator inserted into the second opening and the inner wall of the second opening. If the elastic seal is formed by lips which taper conically downwards and is fixedly connected to the second opening, it has the additional advantage of preventing the fluid from flowing out, even when the container is inclined obliquely downwards. The product is thus prevented from flowing out when the user applies the fluid to the substrate through the needle-like discharge opening, but has forgotten to replace the closure cap with the integrated brush-like applicator in the second opening. In spite of this, the fluid does not flow out through the second opening in this case.

In another advantageous embodiment of the invention, the needle-like discharge opening is designed to be closed by a cap formed with an inspection window. The user is thus readily able to monitor the various functions of the needle-like discharge opening and the brushlike applicator. There is no need for any printing or for special instructions as to which cap to remove for which purpose.

In another embodiment of the invention, the container has at least two opposite flat side walls. The user is readily able to deform the container walls and, in this way, to increase the supply of fluid to the needle-like discharge opening.

The handling of the container is significantly improved in another embodiment by providing the outer wall of the container with profiled handling aids, for example in the form of ribs or even bulges or indentations.

A ball designed to move freely inside the container provides for thorough mixing of the fluid.

BRIEF DESCRIPTION OF DRAWINGS

The invention is described in more detail in the following with reference to the accompanying drawings on an enlarged scale, in which like items are identified by the same reference designation, wherein.

DETAILED DESCRIPTION OF THE DRAWINGS

Figure 1:
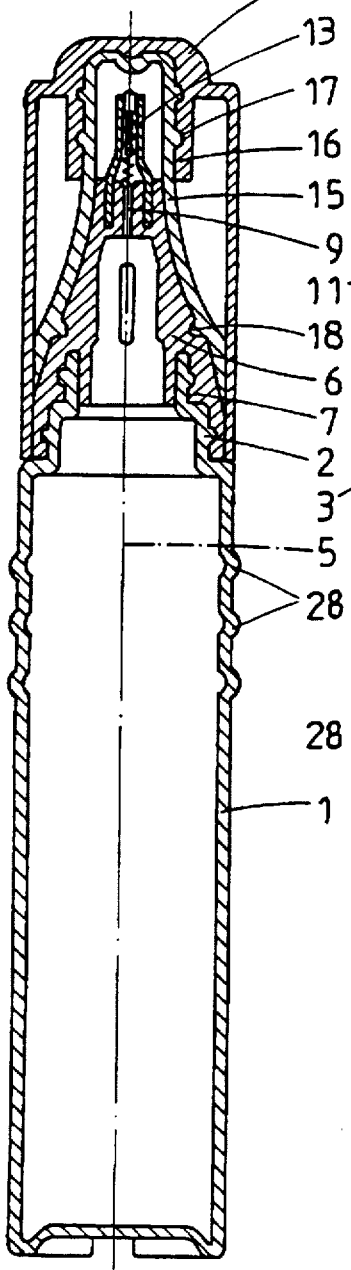
FIG. 1 is a cross-section through a first embodiment of the container according to the invention.
Figure 2:
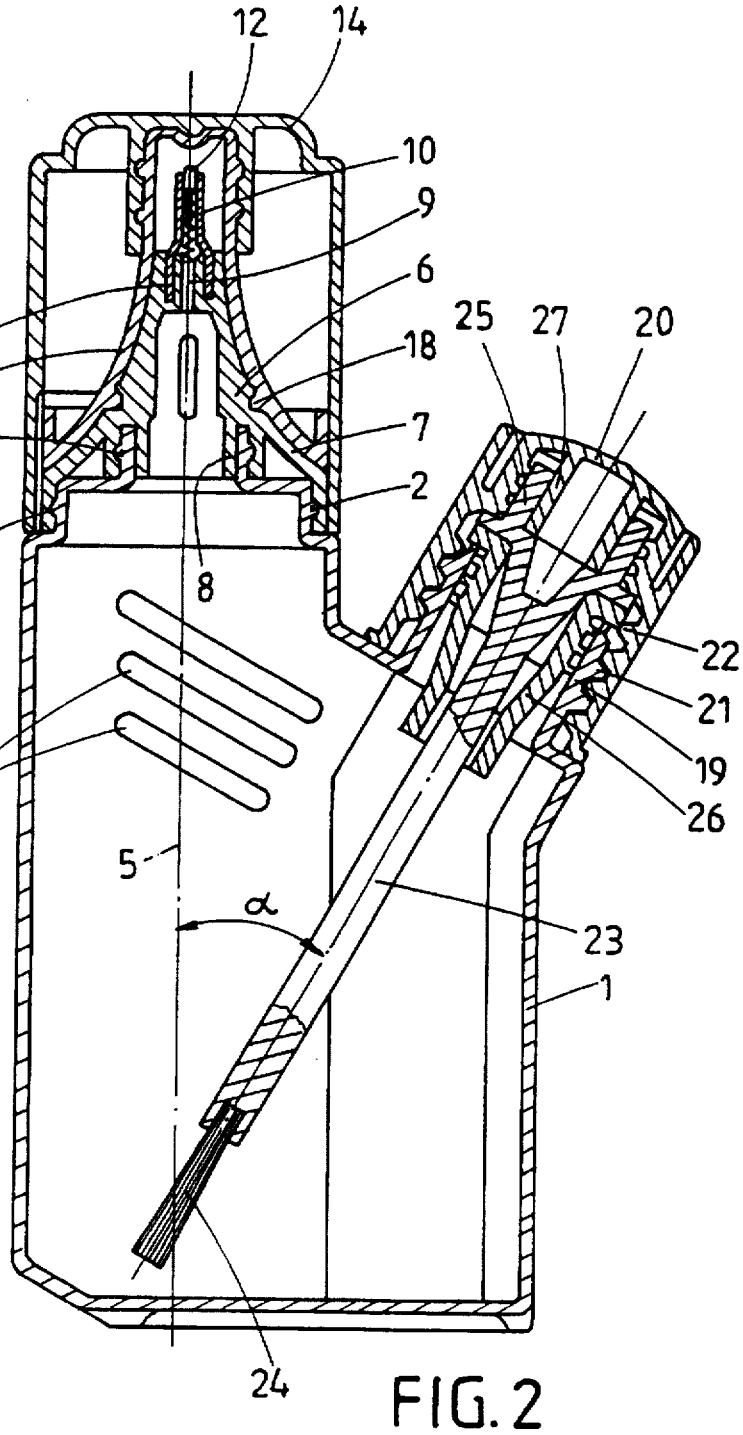
FIG. 2 is a longitudinal section through the container shown in FIG. 1.

A container according to the invention for a fluid product, more particularly correcting fluid, is denoted by the reference 1 in FIGS. 1 and 2. At its upper end, the container 1 comprises a first tube-like projection 2 which, in the embodiment illustrated, tapers towards its free end and preferably comprises two encircling snap beads 3, 4.

The first tube-like projection 2 is arranged in such a way that its longitudinal axis 5 extends vertically when the container is in its standing position.

A substantially conical application tip 6 is snapfitted or force-fitted onto the first tube-like projection 2, the application tip 6 in its fitted position comprising grooves which correspond to the snap beads 3, 4 but which have not been provided with their own reference numerals in the drawing. In addition to the grooved region 7 which externally surrounds the first tube-like projection 2 and which is adapted to the outer contour thereof, the conical application tip 6 is preferably provided on its inside with an annular projection 8 which protrudes locally into the tube-like projection 2 and has a sealing effect.

Formed centrally in the front free end of the application tip 6 is a throughflow opening 9 which opens into a needle-like point 10, for example of metal, which at its broadened cylindrical base 11 is firmly inserted into an annular receiving groove arranged coaxially of the opening 9 at the free end of the application tip 6. The needle-like point 10 is closed by a spherical cap 12 with a valve spring 13, the arrangement being such that, when the needle-like point 10 is applied to a substrate, the spherical cap 12 is pressed inwards into the needle-like point against the pressure of the spring 13, releasing an annular discharge opening so that correcting fluid is able to flow out from the container 1 through the first tube-like projection 2, the application tip 6 and the needle-like point 10 via the discharge opening on the lines of a ball-point pen.

Although not shown in the drawing, the first tube-like projection 2 could also be differently constructed, i.e. in such a way that a valve closure is directly associated with the tube-like projection 2. If the tube-like projection 2 were constructed in this way, there would be no need for the additional parts (application tip 6 and needle-like point 10).

A first closure cap 14 may advantageously be fitted onto the tube-like projection 2. In the embodiment illustrated, the first closure cap 14 is in two parts, i.e. comprises a conical insert 15 in addition to the actual closure cap 14. For firmly joining these two parts, the first closure cap 14 is internally provided with an annular projection 16 with retaining grooves 17 into which the conical insert 15 with corresponding retaining beads is introduced. The conical insert 15 is otherwise designed in such a way that, when the first closure cap 14 is in position, the insert 15 sealingly surrounds the application tip 6. In addition, the insert 15 is provided with an encircling snap bead 18 which engages in a corresponding snap groove formed in the application tip 6. This ensures that the container 1 is tightly closed when the first closure cap 14 is in position.

It is crucial to the design of the container 1 in accordance with the invention that it is additionally provided with a second tube-like projection 19 which is designed to be tightly closed by a second closure cap 20. To this end, the second tube-like projection 19 has an external screwthread 21 while the second closure cap 20 has a corresponding internal screwthread 22 so that the second cap 20 can be screwed on and unscrewed. The second closure cap 20 is provided with an integrated brush-like applicator 23, the tip of the brush being denoted by the reference 24. The brush-like applicator 23 is suitably fixed to the second closure cap 20. In the embodiment illustrated, the brush-like applicator 23 widens tubularly towards the second closure cap 20 (region 25) and, in addition, is surrounded by a tube-like element 26 which acts as a seal and, primarily, as a product stripper and as a centering means for the bristles of the brush. In addition, it acts as a valve against the escape of fluid in the absence of the brush or in the event of overturning of the container 1. The tube-like region 25 is suitably fixed to the second closure cap 20. The second closure cap 20 is preferably provided, for example internally, with an annular extension 27 between which and the outer wall of the second closure cap 20 the tube-like region 25 is force-fitted, screwed, welded or bonded.

The arrangement of the second tube-like projection 19 in relation to the first tube-like projection 2 is such that, when the second closure cap 20 is in position, the free end of the needle-like point 10 of the first tube-like projection 2 extends beyond the second closure cap 20 to such an extent that the fluid is able to flow out freely from the needle-like point 10. At the same time, the arrangement is such that the second closure cap 20 can readily be unscrewed to enable correcting fluid to be removed from the container 1 and applied to a substrate by the brush-like applicator 23. To this end, the two tube-like projections 2 and 19 are preferably arranged at an acute angle a to one another, the angle a in the illustrated embodiment preferably being 30°.

In order further to simplify the handling of the container 1, the outer wall is preferably profiled to form handling aids which, in the embodiment shown in FIGS. 1 and 2, are in the form of ribs 28.

If correcting fluid is to be applied from the container 1 in a small and precisely measured amount, i.e. in substantially spot-like form, the first closure cap 16 is removed so that the needle-like point 10 with the ball valve cap 12 is freely accessible. The point 10 is then applied to the substrate to be coated in the manner of a ball-point pen. When pressure is applied to the spherical cap 12, it moves inwards against the pressure of the spring 13 so that a measured amount of fluid flows out from the container 1. When the point 10 is removed from the substrate, the spherical head 12 moves back into the closed position under the pressure of the spring 13 so that the discharge opening of the first tube-like element 2 is closed again. The first closure cap 16 is then replaced to improve the sealing effect.

If, a relatively large amount of fluid is to be removed, the second closure cap 20 is unscrewed and fluid is removed from the container 1 by the brush-like applicator 23, 24. Because the second closure cap 20 is periodically unscrewed, no reduced pressure can build up in the container 1, as is the case with known correcting pens, so that the spherical cap 12 cannot become blocked, but instead works satisfactorily. In addition, fluid or even diluent can be introduced as and when necessary through the opening in the second tube-like projection 19.

Figure 3:
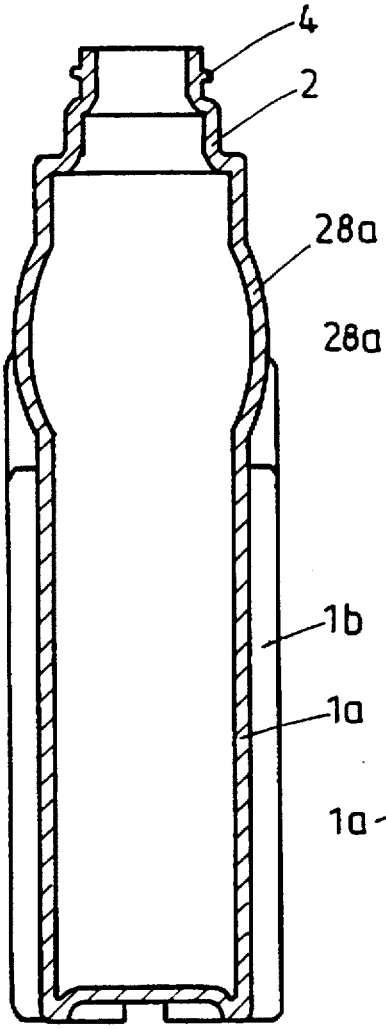
FIG. 3 is a cross-section through a second embodiment of the container according to the invention without any closure caps.
Figure 4:
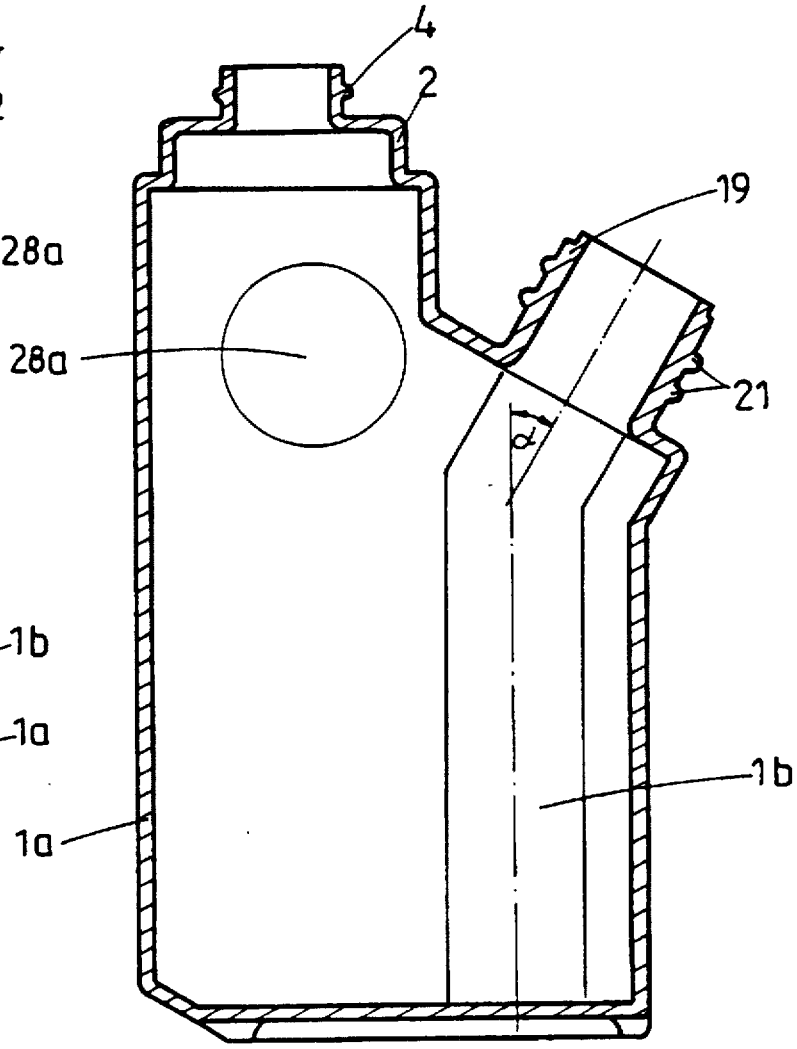
FIG. 4 is a longitudinal section through the container shown in FIG. 3.

FIGS. 3 and 4 show another embodiment without closure caps and without an application tip fitted to the first tube-like projection 2. The main difference between this embodiment and the previous embodiment lies in the shape of the container, the region 1*a* below the first tube-like projection 2 being flat while the region denoted by the reference 1*b* below the second tube-like projection 19 being more cylindrical. In addition, the profile-like handling aids in this embodiment are in the form of partly spherical bulges 28a in the region 1*a*.

In principle, the container could of course be differently designed. It is essential that two different outlet openings are provided and are ergonomically arranged in such a way that, despite the small and difficult-to-handle container 1, the fluid can be satisfactorily applied through the particular opening.

The third embodiment of the invention is described in the following reference to FIGS. 5 to 7.

The device consists of a closed container 31 which is provided with an impervious base 32 and adjoining side walls 33, the upper wall 34 above the base being stepped. The upper part 34' of the upper wall is formed with an opening 35 of which the shape is determined by an upwardly projecting neck 36 (FIG. 6).

Arranged on the neck 36 of the opening 35 is an upwardly tapering injection-molded part 37 on which a needle-like discharge element 38 is disposed. The injection-molded part 37 is formed underneath with an annular channel which is designed to receive the neck 6 of the opening 9. To obtain a snap-action coupling, the neck is provided with a projection 39 which engages in a corresponding recess 40 in the injection-molded part 37.

In addition, in the illustrated embodiment, the outer contour of the upper wall 34' is stepped at 41. The narrow projecting part 42 of the upper wall is also provided with a projection 43 which engages in a recess in a downwardly directed overlap 44 of the injection-molded part 37. A double snap-action coupling is formed in this way for firmly fixing the injection-molded part 37 on the container 31.

The needle-like discharge element 38 is fixed in known manner to the injection-molded part 37, as is a depressible needle 45 which is pushed by a spring 46 into the sleeve of the discharge element 38 and which is connected by the channel 47 in the upper part of the injection-molded part 37 to the hollow chamber 48 of the injection-molded part. The chamber 48 merges underneath with the interior of the container 31.

A cap 50 with an outer part 51 and an inner part 52 can be applied to the injection-molded part 37. The inner part 52 comprises a molding which cooperates with the injection-molded part 37, the projection 53 providing for a snap-action coupling with the part 37. The outer part 51 fits over the injection-molded part 37 and, from the linear guide, merges flush with the outer wall 33 of the container 31.

The cap 50 has a transparent part 54 through which the needle 45 can be seen, even when the cap is in position.

Figure 5:
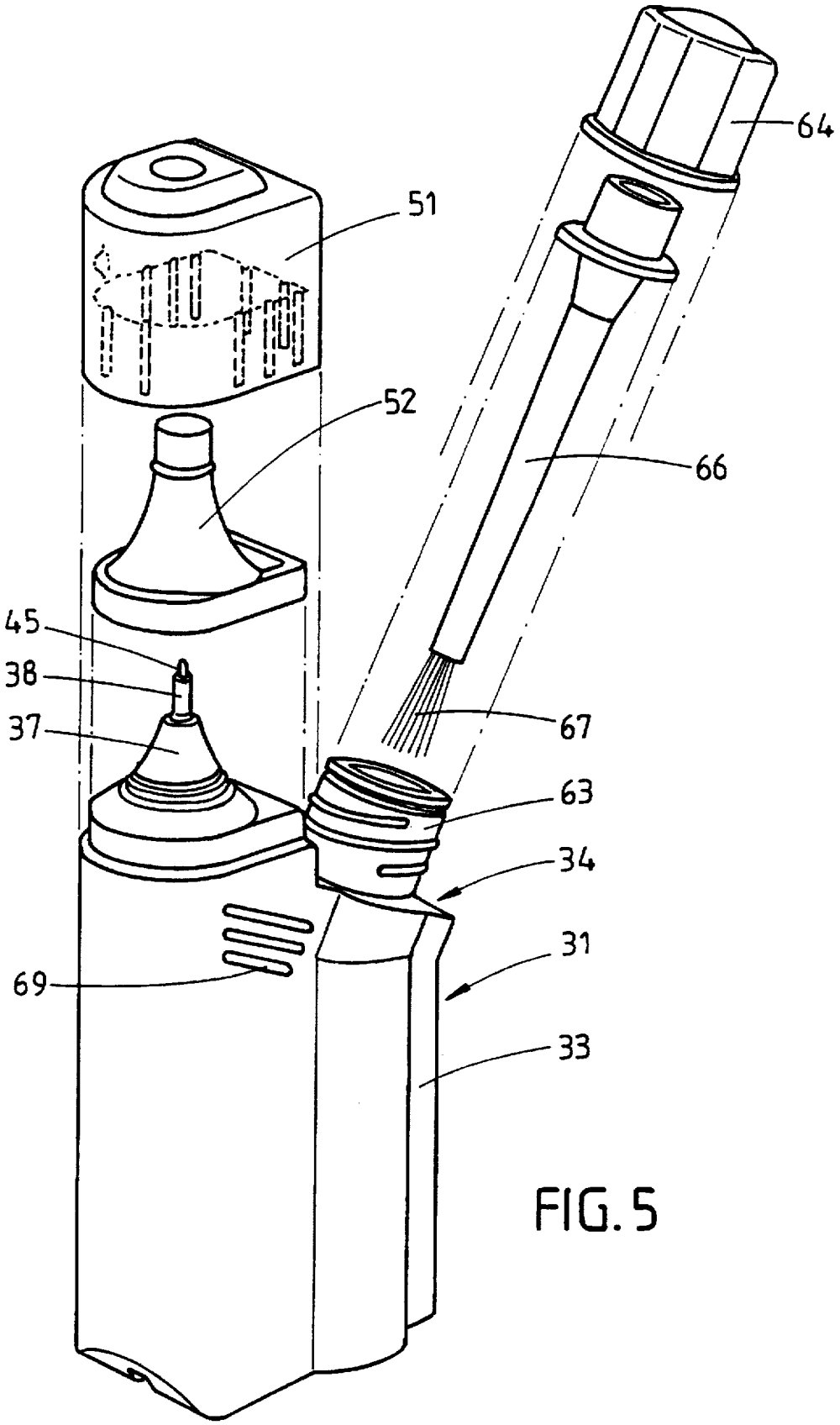
FIG. 5 is a perspective view of a third embodiment of the invention.
Figure 6:
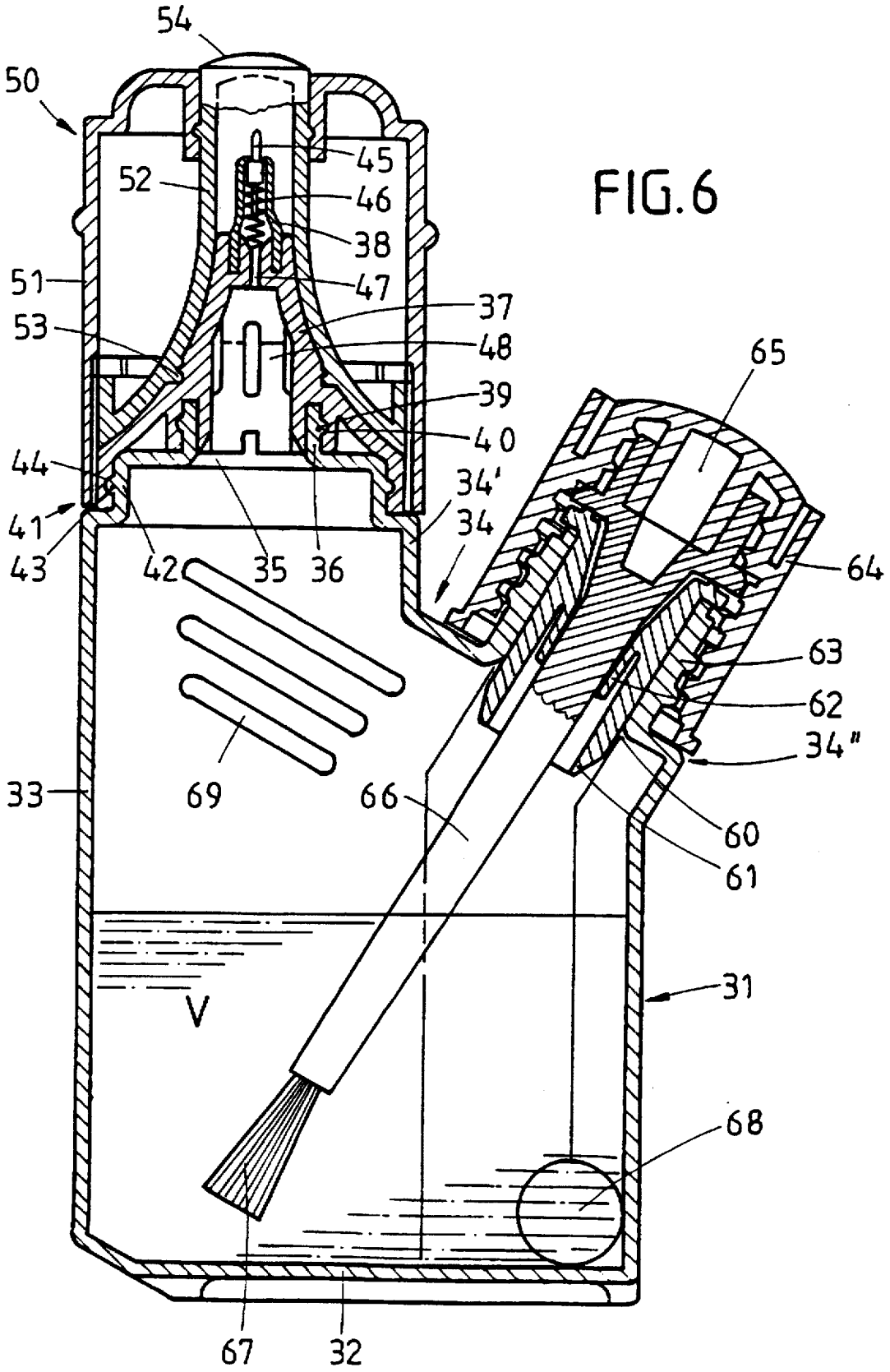
FIG. 6 is a longitudinal section through the container shown in FIG. 5.
Figure 7:
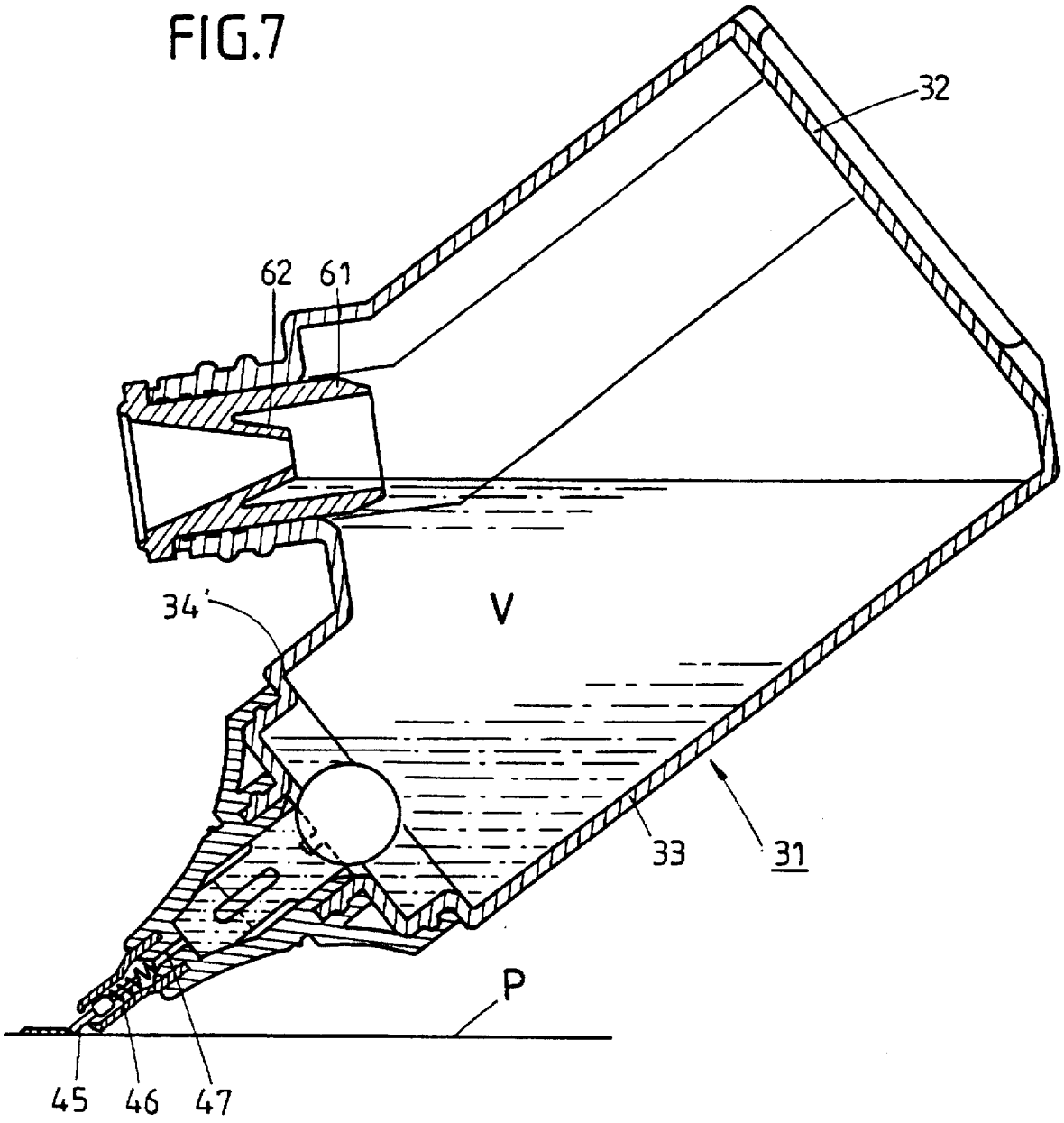
FIG. 7 is the same longitudinal section as FIG. 6 showing the needle-like discharge opening, hereinafter also referred to as "needle", in use.

In the embodiment illustrated in FIGS. 5 to 7, the upper wall 34 is additionally provided with a shoulder 34" which forms an angle with the upper part 34'. Formed in the shoulder 34" is a second opening 60 comprising an insert 61 which has a downwardly directed cylindrical region and a flexible spring member 62 arranged therein.

A male threaded neck 63 for receiving a female threaded cap 64 is also, arranged on the second opening in the shoulder 34" of the container 31. Fixedly arranged on the cap 64 is the base 65 of a handle 66 for a brush 67.

When the cap 64 is unscrewed, it entrains the base 65 so that the brush 67 is removed from the container 31.

The container 31 contains a mixing ball 68 which moves freely in the container in known manner and provides for thorough mixing of the fluid V.

The side walls of the container are provided with ribs 69 which may be used as an indication to the user where to apply finger pressure to apply the fluid to the substrate from the container via the needle 45.

The embodiment shown in FIGS. 5 to 7 is used as follows, starting from the position shown in FIG. 6, the user has the choice of using the needle 45 or the brush 67.

In the first case, the user removes the cap 50 to expose the needle 45. He may then turn the container 31 in such a way that the needle can be applied to the paper P in FIG. 7. When the needle 45 is depressed, the fluid flows from the container 31 via the channel 47 onto the paper P.

When the needle 45 is removed from the paper P, the flow of fluid is automatically interrupted by the needle 45 being pressed outwards by the spring 46 and shutting off the outflow opening. Alternatively, the user may opt to use the brush 67. To this end, the user unscrews the cap 64 from the neck 63, entraining the handle 66 with the brush 67 (FIG. 5).

The use of the brush 67 for spreading is known. After use, the user returns the brush to the container 31 in the reverse sequence.

The handle 66 or rather the brush 67 is positioned in such a way that it extends substantially perpendicularly beneath the opening 35. In this way, the brush 67 remains in the fluid V of the container despite the gradual fall in the fluid level through use.

An effective seal between the handle 66 and the insert 61 is achieved by the elastic spring member 62. The spring member 62 perform a second function, i.e. they retain the fluid V when the device is used in the position shown in FIG. 7. The user may forget to return the handle 66 with the brush 67 into the insert 61 so that liquid could flow out from the insert 61 through the second discharge opening. To overcome this disadvantage, the elastic spring member 62 is sufficiently flexible and its lower ends taper conically so that the opening is almost completely closed.

Although various embodiments of the invention have been shown and described herein, they are not meant to be limiting. Those of skill in the art may recognize certain modifications to these embodiments, which modifications are meant to be covered by the spirit and scope of the appended claims.

What is claimed is:

1. A container for a fluid product, comprising:

a first tube-like projection with a discharge opening having a needle-like actuator projecting therefrom for operating an internal valve closure for the controlled, measured application of the fluid product to a substrate;

a second tube-like projection with a second opening provided with a removable closure cap with an integrated brush-like applicator; and wherein in the standing position of the container, the first and second tube-like projections are arranged in an upper part of the container in such a way that the free end of the first tube-like projection with the discharge opening extends upward, relative to a bottom of said container beyond the closure cap when the second opening is closed.

2. A container as claimed in claim 1, wherein the two tube-like projections are arranged at an acute angle ($\alpha$) to one another.

3. A container as claimed in claim 2, wherein the angle ($\alpha$) between the two tube-like projections is between 20° and 40°.

4. A container as claimed in claim 2, wherein in the standing position of the container, the tube-like projection with the discharge opening has a vertically extending longitudinal axis, and the second tube-like projection is correspondingly laterally aligned.

5. A container as claimed in claim 1, further including an elastic seal between the brush-like applicator inserted into the second opening and the inner wall of the second opening.

6. A container as claimed in claim 1, wherein the needle-like discharge opening is designed to be closed by a cap provided with an inspection window.

7. A container as claimed in claim 1, further including at least two opposite flat side walls of the container.

8. A container as claimed in claim 1, wherein the outer wall of the container is provided with profiled handling aids.

9. A container as claimed in claim 1 further including a ball designed to move freely inside the container.

* * * * *